US005108859A

United States Patent [19]

Bugner et al.

[11] Patent Number: 5,108,859

[45] Date of Patent: Apr. 28, 1992

[54] PHOTOELECTROGRAPHIC ELEMENTS AND IMAGING METHOD

[75] Inventors: Douglas E. Bugner; Louis J. Sorriero, both of Rochester; Sherry L. Marlowe, Rush, all of N.Y.

[73] Assignee: Eastman Kodak Company, Rochester, N.Y.

[21] Appl. No.: 509,119

[22] Filed: Apr. 16, 1990

[51] Int. Cl.[5] ..... G03G 5/06

[52] U.S. Cl. ..... 430/56; 430/96; 430/280

[58] Field of Search ..... 430/56, 96, 280

[56] References Cited

U.S. PATENT DOCUMENTS

| | | | |
|---|---|---|---|
| 2,807,648 | 9/1957 | Pitt . | |
| 3,205,157 | 9/1965 | Licari et al. . | |
| 3,387,974 | 6/1968 | Dulmage et al. . | |
| 3,501,301 | 3/1970 | Nadeau et al . | |
| 3,533,787 | 10/1970 | Merrill et al. . | |
| 3,658,520 | 4/1972 | Brantly et al. . | |
| 3,679,407 | 7/1972 | Stephens . | |
| 3,711,396 | 1/1973 | Ashe et al. . | |
| 3,776,724 | 12/1973 | Usmani . | |
| 3,779,750 | 12/1973 | Merrill et al. . | |
| 3,810,759 | 3/1974 | Stahr et al. . | |
| 3,816,281 | 6/1974 | Feinberg . | |
| 3,829,369 | 8/1974 | Feinberg . | |
| 3,893,935 | 7/1975 | Jadwin et al. . | |
| 3,912,506 | 10/1975 | Merrill . | |
| 3,973,962 | 8/1976 | Contois et al. | 430/75 |
| 3,981,897 | 9/1976 | Crivello . | |
| 4,026,705 | 5/1977 | Crivello . | |
| 4,058,401 | 11/1977 | Crivello . | |
| 4,069,055 | 1/1978 | Crivello . | |
| 4,076,857 | 2/1978 | Kasper et al. . | |
| 4,081,276 | 3/1978 | Crivello . | |
| 4,105,447 | 8/1978 | Fox . | |
| 4,216,288 | 8/1980 | Crivello . | |
| 4,350,751 | 9/1982 | Contois . | |
| 4,529,490 | 7/1985 | Crivello et al. . | |
| 4,546,060 | 10/1985 | Miskinis et al. . | |
| 4,650,734 | 3/1987 | Molaire et al. . | |
| 4,661,429 | 4/1987 | Molaire et al. | 430/96 |

FOREIGN PATENT DOCUMENTS

| | | |
|---|---|---|
| 0212315 | 11/1957 | Australia . |
| 1388492 | 3/1975 | United Kingdom . |
| 1516511 | 7/1978 | United Kingdom . |
| 1526923 | 10/1978 | United Kingdom . |

*Primary Examiner*—Marion E. McCamish
*Assistant Examiner*—S. Rosasco
*Attorney, Agent, or Firm*—Willard G. Montgomery

[57] ABSTRACT

A photoelectrographic element comprising a conductive layer in electrical contact with an acid photogenerating layer which is (a) free of photopolymerizable materials and (b) comprises an electrically insulating binder and an acid photogenerator is disclosed in which the binder comprises a polymer having as a repeating unit thereof a moiety selected from the group consisting of:

I

II wherein R represents an alkylene group having 2, 4 or 6 carbon atoms and X represents an aromatic radical. A method of forming images with the element also is disclosed.

41 Claims, No Drawings

PHOTOELECTROGRAPHIC ELEMENTS AND IMAGING METHOD

FIELD OF THE INVENTION

This invention relates to new photoelectrographic elements and an imaging method using such elements.

BACKGROUND OF THE INVENTION

Acid photogenerators, per se, are known as are their use in photoresist imaging elements. Acid photogenerators are disclosed, for example, in U.S. Pat. Nos. 4,081,276; 4,058,401; 4,026,705; 2,807,648; 4,069,055 and 4,529,490. In recently issued U.S. Pat. No. 4,661,429 to Molaire, et al., there is disclosed a photoelectrographic element for use in a photoelectrographic process which comprises a conductive layer in electrical contact with an acid photogenerating layer which (a) is free of photopolymerizable materials and (b) comprises an electrically insulating binder and an acid photogenerator. The photoelectrographic process disclosed therein comprises the steps of:

(a) providing a photoelectrographic element comprising a conductive layer in electrical contact with an acid photogenerating layer which (i) is free of photopolymerizable materials and (ii) comprises an electrically insulating binder and an acid photogenerator;

(b) carrying out the following steps (b)(i) and (b)(ii) concurrently or separately in any order to form an electrostatic image, (i) imagewise exposing the acid photogenerating layer to actinic radiation, (ii) electrostatically charging the acid photogenerating layer, and (c) developing the electrostatic latent image with charged toner particles.

The imaging technique or method disclosed by Molaire, et al., takes advantage of the fact that exposure of the acid generator significantly increases the charge decay of the electrostatic charges in the exposed area of the layer. Imagewise irradiation of the acid photogenerator layer creates differential charge decay between exposed and unexposed areas. When imagewise irradiation is coupled with the step of electrostatic charging, this differential charge decay or imagewise conductivity differential forms or creates an electrostatic latent image. The latent image is developed by contacting the photoelectrographic layer with a charged toner composition of the type used in electrophotographic development operations. Such toner compositions are well known, being described in numerous patents and other literature such as U.S. Pat. Nos. 2,296,691; 4,546,060; 4,076,857 and 3,893,935. In the Molaire, et al., process, exposure can occur before, after or simultaneously with the charging step. This is different from electrophotographic imaging techniques where the electrophotographic element must always be charged electrostatically prior to exposure.

The photoelectrographic elements of Molaire, et al., also are advantageous in that the imagewise differential charge decay of electrostatic charges are erasable with heat. In addition, the imagewise conductivity differential created by the exposure is permanent unless the element is subjected to heat. Thus, multiple copies of a document can be made from a single exposure. Further, the photoelectrographic layer can be developed with a charged toner having the same polarity as the latent electrostatic image or with a charged toner having a different polarity from the latent electrostatic image. In one case, a positive image is formed. In the other case, a negative image is formed. Alternatively, the photoelectrographic layer can be charged either positively or negatively, and the resulting electrostatic latent images can be developed with a toner of given polarity to yield either a positively or negatively toned image. According to Molaire, et al., any compound which generates an acid upon exposure can be used in the photoelectrographic element. However, aromatic onium salts, including triarylselenonium salts and aryldiazonium salts, and 6-substituted-2,4-bis(trichloromethyl)-5-triazines are especially preferred.

While the photoelectrographic elements of Molaire, et al., constitute a significant contribution to the art, they suffer from the disadvantage that they are sensitive to variations in the moisture content of the surrounding atmosphere. That is, as the relative humidity in the surrounding atmosphere increases, the photoelectrographic elements of Molaire, et al., become more conductive. Conversely, as the relative humidity in the surrounding atmosphere decreases, they become less conductive and more insulating. This change in conductivity is observed for both the exposed and unexposed regions or areas of the photoelectrographic element to differing extents depending upon the specific formulation of the element. For example, in certain instances, under high relative humidity conditions, the unexposed area of a particular element may not be capable of supporting a charge high enough to create a potential difference between the exposed and unexposed areas which is sufficient to yield a toned image of acceptable contrast. That is, either the $D_{max}$ areas are much lower in density than desired or the $D_{min}$ areas are darker than desired. Conversely, in other photoelectrographic elements of different formulations, under low relative humidity conditions, the exposed areas of the element may only discharge to a level which is insufficiently lower than the level retained on the unexposed areas of the element. Again, the difference in potential available for toning is too small to yield images of acceptable contrast and quality. Furthermore, while a given formulation may perform adequately at a given relative humidity, its electrical performance may change significantly in response to changes in relative humidity such that image quality becomes unacceptable. Such a formulation would not be generally useful is widely varying climates around the world.

In addition, the photoelectrographic elements of Molaire, et al., suffer from other disadvantages in that certain of the binders used by Molaire, et al., in the acid photogenerating layer exhibit undesirable defects, such as poor adhesion to the conducting or barrier layers used in the element, as in the case of certain of the polycarbonates such as bisphenol-A, and other defects, such as brittleness or crazing, which precludes the element or film from being used in the form of a drum, as in the case of poly(vinyl phenol), for example, which requires a flexible film that will not crack when it is bent or wrapped around a cylinder.

Accordingly, it would be highly desirable to be able to provide a photoelectrographic element of the type described by Molaire, et al., which not only possesses all of the desirable above-mentioned properties and features but, in addition, one which is substantially insensitive to widely varying changes in relative humidity which are encountered during normal operating conditions so that both charge acceptance and the persistent photo-induced conductivity remain within the range required for high quality imaging. Further, it would also be highly desirable to provide such an element which is free of the above-mentioned defects such as poor adhesion, brittleness and crazing. The present invention provides such a photoelectrographic element and a method of forming images with the element.

SUMMARY OF THE INVENTION

In accordance with the present invention, novel photoelectrographic elements are provided which comprise a conductive layer in electrical contact with an acid photogenerating layer which (a) is free of photopolymerizable materials and (b) comprises an acid photogenerator and an electrically insulating binder which exhibit reduced sensitivity to changes in the relative humidity as a result of the particular polymeric materials which are used in the element to form the binder component of the acid photogenerating layer. In addition, the photoelectrographic elements of the invention exhibit good flexibility and display good adhesion of the photogenerating layer to the underlying barrier or conductive layer.

DESCRIPTION OF THE PREFERRED EMBODIMENTS

In preparing the acid photogenerating layers of the present invention, the acid photogenerator is dissolved in a suitable solvent in the presence of the electrically insulating polymeric binders employed in the present invention.

Solvents of choice for preparing coating compositions of the acid photogenerators include a number of solvents such as aromatic hydrocarbons such as toluene; acetone, 2-butanone; chlorinated hydrocarbons such as ethylene dichloride, trichloroethane and dichloromethane; ethers such as tetrahydrofuran; or mixtures of these solvents.

The acid photogenerating layers are coated on a conducting support in any well-known manner such as doctor-blade coating, swirling, dip-coating, and the like.

Suitable conducting layers include any of the electrically conducting layers and supports used in electrophotography. These include, for example, paper; aluminum-paper laminates; metal foils, such as aluminum foil, zinc foil, etc.; metal plates, such as aluminum, copper, zinc, brass and galvanized plates; regenerated cellulose and cellulose derivatives; certain polyesters, especially polyesters having a thin electroconductive layer (e.g., cuprous iodide) coated thereon, and the like.

While the acid photogenerating layers of the present invention can be affixed, if desired, directly to a conducting substrate or support, it may be desirable to use one or more intermediate subbing layers between the conducting layer or substrate and the acid photogenerating layer to improve adhesion to the conducting substrate and/or to act as an electrical and/or chemical barrier between the acid photogenerating layer and the conducting layer or substrate.

Such subbing layers, if used, typically have a dry thickness in the range of about 0.1 to about 5 microns. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Representative vinylidene chloride-containing polymers are vinylidene chloride-methyl methacrylate-itaconic acid terpolymers. Various vinylidene chloride containing hydrosol tetrapolymers which are useful include tetrapolymers of vinylidene chloride, methyl acrylate, acrylonitrile, and acrylic acid. Other useful vinylidene chloride-containing copolymers include poly(vinylidene chloride-methacrylonitrile), poly(vinylidene chloride-acrylonitrile), and poly(vinylidene chloride-acrylonitrilemethyl acrylate). Other useful subbing materials include the so-called tergels which are described in Nadeau et al, U.S. Pat. No. 3,501,301.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and accordingly an extended discussion thereof is unnecessary. Several such overcoats are described, for example, in *Research Disclosure*, "Electrophotographic Elements, Materials, and Processes", Vol. 109, page 63, Paragraph V, May, 1973, which is incorporated herein by reference.

The acid photogenerating materials should be chosen so that at certain concentrations in the layer, the layer has a relatively small charge decay before irradiation, but the charge decay level should increase by irradiation exposure. In preparing the coating composition, useful results are obtained where the acid photogenerator is present in an amount equal to at least about 1 weight percent of the coated layer. The upper limit of the amount of acid photogenerator is not critical as long as it does not cause any deleterious effect on the initial charge decay of the film or on the physical properties of the film such as wear or brittleness, for example. A preferred weight range for the acid photogenerator in the coated and dried composition is from about 10 weight percent to about 60 weight percent.

Coating thicknesses of the acid photogenerator can vary widely. Normally a dry coating thickness in the range from about 1.0 μm to about 50 μm are useful. A particularly preferred coating thickness range is from about 6 μm to 10 μm. Coating thicknesses outside these ranges may also be useful.

The photoelectrographic elements of the present invention are employed in the photoelectrographic process described hereinafter. In this process, the layer is exposed imagewise, and the element is given a blanket electrostatic charge by placing the same under a corona discharge which serves to give a uniform charge to the surface of the acid photogenerator layer. Exposure and charging can be carried out in any order or at the same time. The charge is dissipated by the layer in exposed areas. Thus, the combination of the charging and imagewise exposure steps create an electrostatic latent image of the type produced in electrophotographic processes.

The electrostatic latent image is then developed, or transferred to another sheet and developed, by treatment with a medium comprising electrostatically attractable particles. Such particles are used extensively in developing electrophotographic images. The particles are generically referred to as toners. The toners are in the form of a dust, a powder, a pigment in a resinous carrier, or in a liquid developer in which the toner particles are carried in an electrically insulating liquid carrier. Methods of development of this type are widely known and have been described in the electrophotographic patent literature in such patents, for example, as U.S. Pat. No. 2,296,691 and in Australian Pat. No. 212,315.

The charged toner may have the same polarity as the electrographic latent image or the opposite polarity. In the former case, a negative image is developed. In the latter case, a positive image is developed.

Any compound which generates a strong acid upon exposure will be useful. Useful aromatic onium salt acid photogenerators are disclosed in U.S. Pat. Nos. 4,081,276; 4,529,490; 4.216,288; 4,058,401; 4,069,055; 3,981,897; and 2,807,648. Such aromatic onium salts include Group Va, Group VIa and Group VIIa elements. The ability of triarylselenonium salts, aryldiazonium salts and triarylsulfonium salts to produce protic acids upon exposure to light is described in detail in "UV Curing, Science and Technology", Technology Marketing Corporation, Publishing Division, 1978.

A representative portion of the useful aryl iodonium salts are the following:

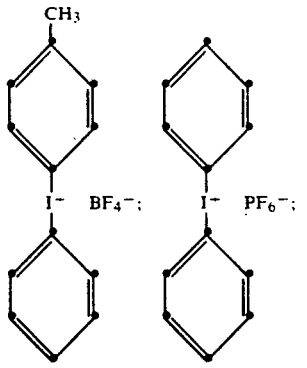

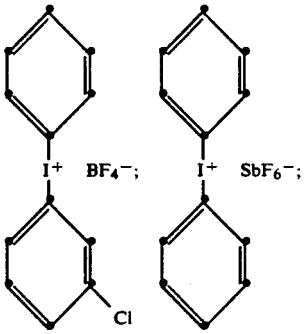

-continued

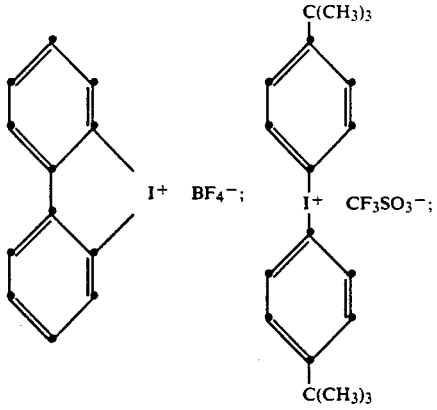

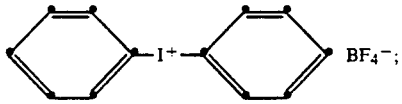

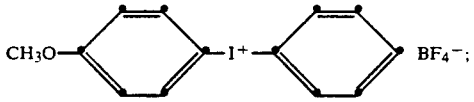

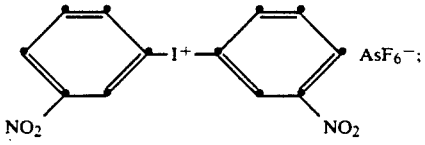

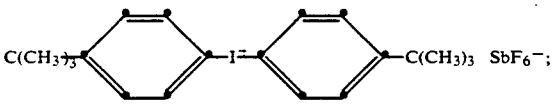

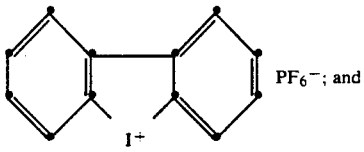

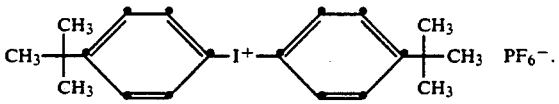

A representative portion of useful Group Va onium salts are:

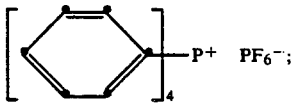

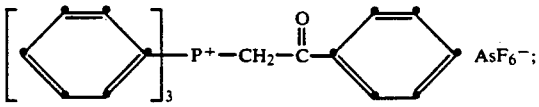

-continued
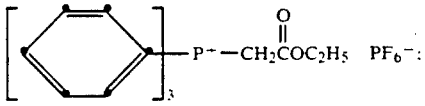
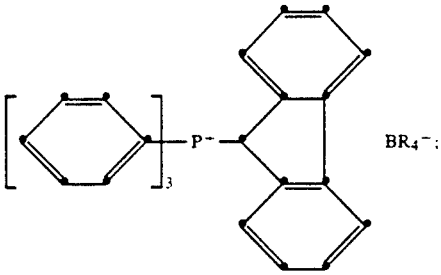
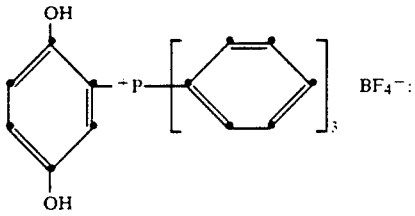
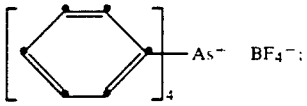
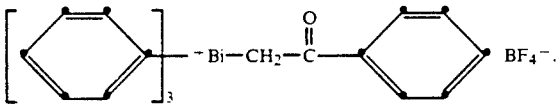
A representative portion of useful Group VIa onium salts, including sulfonium salts, are:
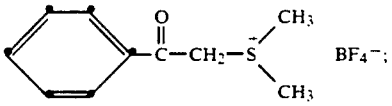
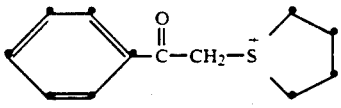
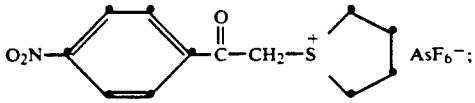
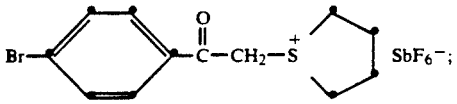
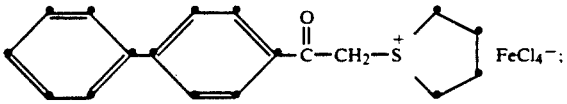
-continued
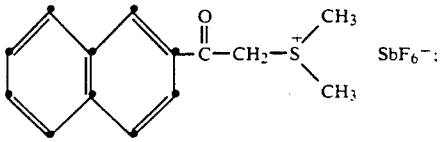
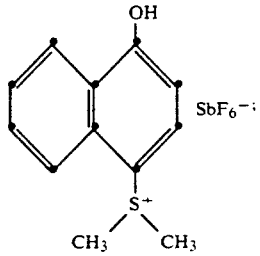
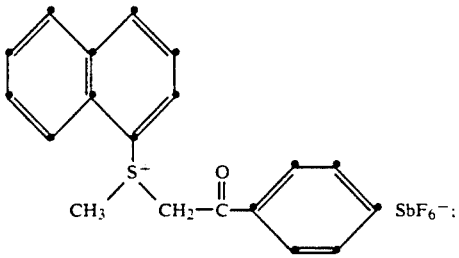
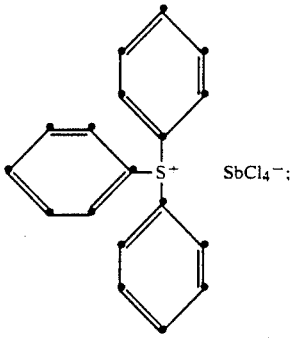
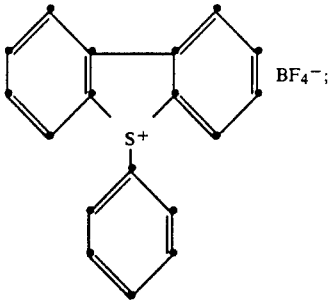
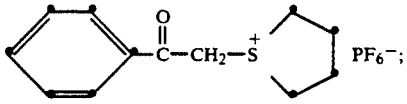
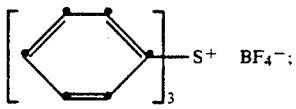

-continued

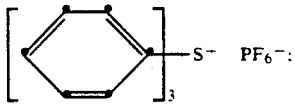

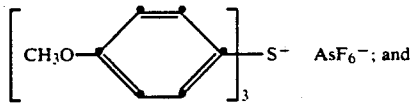

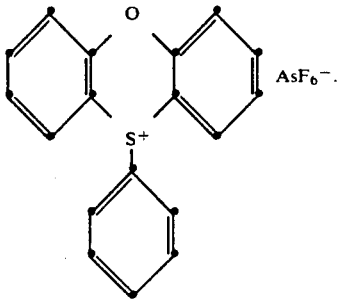

Other salts from which acid photogenerators may be selected are:

1. Triarylselenonium salts, such as disclosed in Belgian Pat. Nos. 828,670 and 833,472. The following salts are representative:

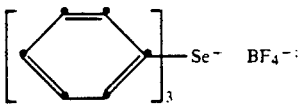

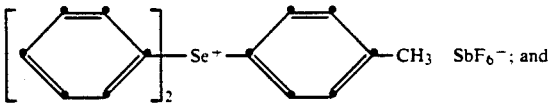

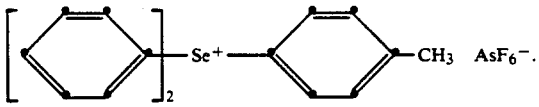

2. Aryldiazonium salts such as disclosed in U.S. Pat. Nos. 3,205,157; 3,711,396; 3,816,281; 3,817,840 and 3,829,369. The following salts are representative:

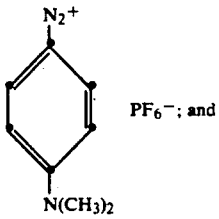

-continued

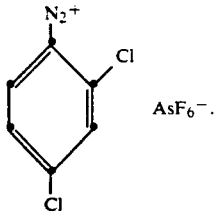

3. 6-Substituted-2,4-bis(trichloromethyl)-5-triazines such as disclosed in British Pat. No. 1,388,492. The following compounds are representative:

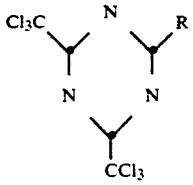

R

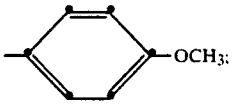

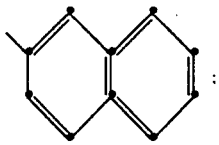

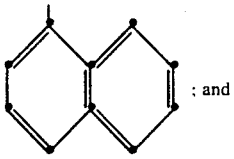

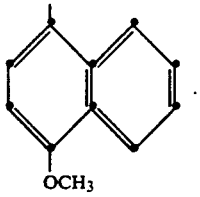

Such acid photogenerators are disclosed in U.S. Pat. No. 4,661,429 which is incorporated herein by reference.

In contrast to the typical conventional binders composed of ordinary polymeric materials, e.g., phenolic resins, polyesters, polycarbonates, styrene-butadiene copolymers and the like which are disclosed by Molaire, et al., for use in the acid photogenerating layers of the Molaire, et al., photoelectrographic elements, the polymeric binders used in the acid photogenerating layers of the photoelectrographic elements of the present invention can be represented as follows:

Homopolymers having repeating units of:

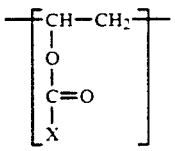

I or

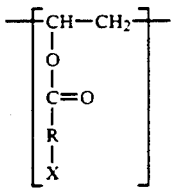

II or copolymers having repeating units of I and II above, or copolymers wherein at least one of the repeating units thereof is I or II above, and wherein at least another repeating unit thereof is selected from the group consisting of:

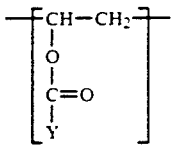

III and

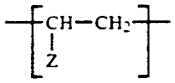

IV wherein R, X, Y and Z set forth in the above formulas I-IV are defined below.

R represents an alkylene group having 2, 4 or 6 carbon atoms.

X represents an aromatic radical including a substituted aromatic radical. Representative radicals include a mononuclear or polynuclear monovalent aromatic radical, either fused or linear (e.g., phenyl, naphthyl, biphenyl, etc.), or a substituted divalent aromatic radical wherein said substituent can comprise a member, such as an acyl group having 1 to about 6 carbon atoms (e.g., acetyl, propionyl, butyryl, etc.), an alkyl group having 1 to about 6 carbon atoms (e.g., methyl, ethyl, propyl, butyl, etc.), an alkoxy group having from 1 to about 6 carbon atoms (e.g., methoxy, propoxy, pentoxy, etc.), or a halogen substituent such as a chlorine, bromine, iodine or fluorine atom.

Y represents a lower alkyl group having 1 to about 8 carbon atoms such as methyl, ethyl, propyl, butyl, isobutyl, etc.

Z represents a hydroxy radical.

In those embodiments of the invention where copolymers are provided as described above, the resultant copolymers generally should have substantial amounts of repeating units having formula I or II above. Typically, the polymer should contain at least 50 weight percent of such repeating units, and preferably about 90 weight percent. If a copolymer is employed as the binder, the structure may be that of a block, heteroblock or random copolymer. The molecular weight preferably should be in the range of 1000 to 1,000,000, more preferably 10,000 to 100,000.

Exemplary of a few of the many resins useful as binders in this invention are:

poly(vinyl benzoate),
poly(vinyl 2-naphthoate),
poly(vinyl benzoate-co-vinyl acetate),
poly(vinyl 2-naphthoate-co-vinyl acetate),
poly(vinyl 1-naphthoate-co-vinyl acetate),
poly(vinyl cinnamate),
poly(vinyl 5-phenyl-2,4-pentadienoate),
poly(vinyl cinnamate-co-vinyl 1-naphthoate),
poly(vinyl p-chlorobenzoate-co-vinyl acetate),
poly(vinyl m-chlorobenzoate-co-vinyl acetate),
poly(vinyl o-chlorobenzoate-co-vinyl acetate),
poly(vinyl p-bromobenzoate-co-vinyl acetate),
poly(vinyl m-bromobenzoate-co-vinyl acetate),
poly(vinyl o-bromobenzoate-co-vinyl acetate),
poly(vinyl p-iodobenzoate-co-vinyl acetate),
poly(vinyl m-iodobenzoate-co-vinyl acetate),
poly(vinyl o-iodobenzoate-co-vinyl acetate),
poly(vinyl p-fluorobenzoate-co-vinyl acetate),
poly(vinyl m-fluorobenzoate-co-vinyl acetate),
poly(vinyl o-fluorobenzoate-co-vinyl acetate),
poly(vinyl 5-bromo-2-naphthoate-co-vinyl acetate),
poly(vinyl 4-bromo-1-naphthoate-co-vinyl acetate),
poly(vinyl 5-bromo-1-naphthoate-co-vinyl acetate),
poly(vinyl 2,4-dichlorobenzoate-co-vinyl acetate),
poly(vinyl 3-bromobenzoate-co-vinyl acetate-co-vinyl alcohol),
poly(vinyl p-acetoxybenzoate-co-vinyl acetate),
poly(vinyl m-acetoxybenzoate-co-vinyl acetate),
poly(vinyl o-acetoxybenzoate-co-vinyl acetate),
poly(vinyl 3-acetoxybenzoate-co-vinyl acetate-co-vinyl alcohol),
poly(vinyl p-methylbenzoate-co-vinyl acetate),
poly(vinyl m-ethylbenzoate-co-vinyl acetate),
poly(vinyl o-propylbenzoate-co-vinyl acetate),
poly(vinyl 3-butylbenzoate-co-vinyl acetate-co-vinyl alcohol),
poly(vinyl p-methoxybenzoate-co-vinyl acetate),
poly(vinyl m-ethoxybenzoate-co-vinyl acetate),
poly(vinyl o-propoxybenzoate-co-vinyl acetate),
poly(vinyl 3-butoxybenzoate-co-vinyl acetate-co-vinyl alchol), and the like.

The polymers which or the electrically insulating binders used in the acid photogenerating layers of the photoelectrographic elements of the present invention are known polymers and are prepared by methods known to those skilled in the art. Typically, the polymers may be made by reacting in pyridine a suspension of existing vinyl polymers containing free hydroxyl groups with (a) appropriate acid chloride derivatives of aromatic carboxylic acids such as benzoyl chloride and, if desired, (b) other reactants which preferably can contribute desirable sensitometric and/or physical properties, for example, acetyl chloride. The reaction is carried out at about 30° to 60° C. The polymer is recovered by precipitation in water and is purified by reprecipitation in methanol from dichloromethane solution.

Spectral or speed enhancing sensitizing compounds can be added to acid generating compositions used in the practice of the present invention, if desired.

The amount of spectral or speed enhancing sensitizer which can be added to a particular acid generating composition to give optimum sensitization varies widely. The optimum amount will, of course, vary with the acid photogenerator used and the thickness of the coating, as well as with the particular sensitizer. In general, substantial speed gains and wavelength adjustments can be obtained where an appropriate sensitizer is added at a concentration up to about 30 percent by weight based on the weight of the acid generating composition.

The iodonium salt acid photogenerators may be sensitized using ketones such as xanthones, indandiones, indanones, thioxanthones, acetophenones, benzophenones or other aromatic compounds such as anthracenes, diethoxyanthracenes, perylenes, phenothiazines, and the like.

Triarylsulfonium salt acid generators may be sensitized by aromatic hydrocarbons, anthracenes, perylenes, pyrenes and phenothiazines.

Applicants have found, quite unexpectedly, that if the foregoing polymeric materials are employed as the binder material in the acid photogenerating layers of the Molaire, et al., photoelectrographic elements, that such elements exhibit a significantly improved insensitivity to variations in the moisture content of the surrounding atmosphere.

Thus, in one embodiment of the present invention there is provided a photoelectrographic element comprising a conductive layer in electrical contact with an acid photogenerating layer which is (a) free of photopolymerizable materials and (b) comprises an electrically insulating binder and an acid photogenerator wherein the electrically insulating binder comprises a polymer having as a repeating unit thereof a moiety selected from the group consisting of:

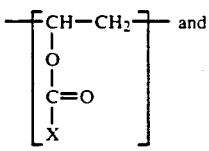
and I

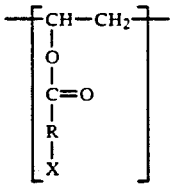
II wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent and aromatic radicals having a halogen substituent.

In another embodiment of the invention, there is provided a photoelectrographic element comprising a conductive layer in electrical contact with an acid photogenerating layer which (a) is free of photopolymerizable materials and (b) comprises an electrically insulating binder and an acid photogenerator wherein the electrically insulating binder is a copolymer comprising at least two different repeating units wherein one repeating unit is selected from the group consisting of:

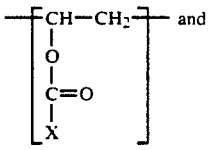
and I

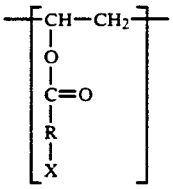
II wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent and aromatic radicals having a halogen substituent; and another of said repeating units is selected from the group consisting of:

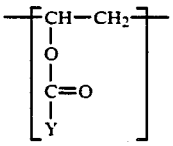
III and

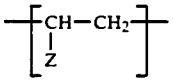
IV wherein Y represents a lower alkyl radical having from 1 to about 8 carbon atoms and Z represents a hydroxy radical.

In still another embodiment of the present invention, there is provided a photoelectrographic imaging method comprising the steps of:

(a) providing a photoelectrographic element comprising a conductive layer in electrical contact with an acid photogenerating layer which (i) is free of photopolymerizable materials and (ii) comprises an electrically insulating binder and an acid photogenerator wherein the electrically insulating binder comprises a polymer having as a repeating unit thereof a moiety selected from the group consisting of:

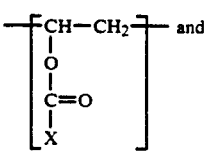
and I

-continued

II

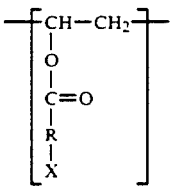

wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent, and aromatic radicals having a halogen substituent;

(b) carrying out the following steps (b) (i) and (b) (ii) concurrently or separately in any order, to form an electrostatic latent image, (i) imagewise exposing the acid photogenerating layer to actinic radiation, (ii) electrostatically charging the acid photogenerating layer, and (c) developing the electrostatic latent image with charged toner particles.

In a still further embodiment of the present invention, there is provided a photoelectrographic imaging method comprising the steps of:

(a) providing a photoelectrographic element comprising a conductive layer in electrical contact with an acid photogenerating layer which (i) is free of photopolymerizable materials and (ii) comprises an electrically insulating binder and an acid photogenerator wherein the electrically insulating binder is a copolymer comprising at least two different repeating units, one of said repeating units selected from the group consisting of:

I

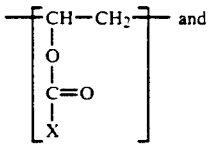

and

II

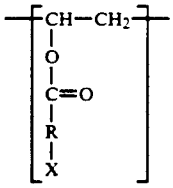

wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent and aromatic radicals having a halogen substituent; and another of said repeating units selected from the group consisting of:

III

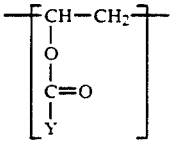

and

IV

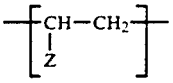

wherein Y represents a lower alkyl radical having from 1 to about 8 carbon atoms, and Z represents a hydroxy radical;

(b) carrying out the following steps (b) (i) and (b) (ii) concurrently or separately in any order, to form an electrostatic latent image, (i) imagewise exposing the acid photogenerating layer to actinic radiation, (ii) electrostatically charging the acid photogenerating layer, and (c) developing the electrostatic latent image with charged toner particles.

The invention is further illustrated by the following examples which include preferred embodiments thereof.

EXAMPLE 1

The purpose of this example is to show the general synthetic procedure used to prepare the polymers used as the electrically insulating binders in the photoelectrographic elements of this invention.

Poly(vinyl alcohol-co-vinyl acetate) (88/12 molar ratio) sold commercially under the tradename Vinol 523 by Air Products and Chemicals, Inc., Allentown, Pa., was oven dried at 70° C. for 16 hours. A suspension of the dried Vinol 523 (65 grams; 1.3 mol) in pyridine (623 mL) was heated to 90° C. for 22 hours. Additional pyridine (165 mL) was added, and the mixture was stirred another 2 hours at 90° C. The mixture was cooled to 40° C., and benzoyl chloride (168.5 mL; 1.45 mol) was added dropwise over 2.5 hours while maintaining the temperature between 45° and 55° C. After addition was complete, the temperature was increased to 60° C. for 2 hours. The reaction was cooled to room temperature and acetone (1.0 L) was added to dilute the viscous mixture. The mixture was stirred overnight under an inert atmosphere. The polymer was isolated in several batches from ice water in a high-shear blender. The resulting polymer was soaked in fresh water for 3 to 4 hours three successive times and then air-dried overnight. The dried polymer was dissolved in dichloromethane and reprecipitated from methanol. The solid was collected by filtration and dried in a vacuum oven (nitrogen bleed) at room temperature for 2 days and then at 45° C. for 1 day. A total of 161 grams of poly(vinyl benzoate-co-vinyl acetate) (88/12 molar ratio) was obtained.

Calcd. for $(C_9H_8O_2)_{0.88}$ $(C_4H_6O_2)_{0.12}$: 71.70% C; 5.56% H.

Found: 71.97% C; 5.66% H.

EXAMPLE 2

A general formulation consisting of 11.25 weight percent poly(vinyl benzoate-co-vinyl acetate) (88/12 molar ratio) as binder, 3.0 weight percent di(t-butylphenyl)iodonium triflate as the acid photogenerator, and 0.75 weight percent 9,10-diethoxyanthracene as the sensitizer, was completely dissolved in 85 weight percent dichloromethane. The formulation was hand-coated with a 4 mil doctor blade on a polyester support which had previously been overcoated with successive layers of (a) cuprous iodide in poly(vinyl formal) as a conductive layer (0.5 μm thick) and (b) cellulose nitrate as a barrier layer (1.5 μm thick). The coating was dried in an oven at 60° C. for 2 hours. A good quality coating free from defects, such as poor adhesion of the acid photogenerating layer to the barrier layer, brittleness and crazing, was obtained. Evaluation of a cross-section of the film by photomicroscopy revealed that the acid photogenerating layer was 8.6 μm thick.

The film was cut into two 35 mm × 337 mm strips, one for each of the high and low RH (i.e. relative humidity) conditions described below. Approximately one-half of each sample film strip (35 mm × 150 mm) was exposed with light from a 500 watt mercury arc lamp with a total irradiance of about 3 joules/cm$^2$.

The photoelectrographic properties of each film sample were evaluated by mounting it in electrical contact with a metal drum, and rotating the drum past a corona charger and an electrostatic voltmeter. The configuration is such that a given area of the film passes in front of the charger and voltmeter once every second, with the time between the charger and voltmeter being about 200 milliseconds. The grid potential on the charger is set at +700 volts, with 0.40 ma current. The voltmeter measures the surface potential on both the exposed and unexposed regions of the film each cycle. After several cycles, both exposed and unexposed regions of the film reach equilibrium potentials. The equilibrium potential in the unexposed region is termed $V_{max}$ and the equilibrium potential in the exposed region is termed $V_{min}$. The difference between $V_{max}$ and $V_{min}$ is called del V, and represents the potential available for development. Since $V_{max}$ varies with respect to RH and to film thickness and specific formulation, and since del V is a function of $V_{max}$, it is difficult to compare del V's by themselves from one measurement to the next. However, we have found that the degree of discharge, i.e., the ratio of del V to $V_{max}$ is independent of $V_{max}$ in the range of 400 to 800 volts. Therefore, for the purpose of comparing the photoelectrographic behavior of the various inventive formulations, the values of $V_{max}$ and del $V/V_{max}$ will be used. Ideally, del $V/V_{max}$ should not change in response to changes in RH, but should remain constant.

For this example and each of the following examples, one sample was measured at 70° F. and 30% RH, and the other sample was measured at 80° F. and 70% RH. Each sample was allowed to equilibrate at the selected temperature and RH for at least one hour between exposure and evaluation. The results are set forth in the table below, along with the results for additional examples 3–8 set forth immediately hereafter.

EXAMPLE 3

A film was prepared exactly as described in Example 2 except that poly(vinyl 3-bromobenzoate-co-vinyl acetate) (88/12 molar ratio) was used in place of poly (vinyl benzoate-co-vinyl acetate). A good quality flexible film free of crazing was obtained. The thickness of the acid photogenerating layer was 7.0 μm.

EXAMPLE 4

A film was prepared exactly as described in example 2 except that poly(vinyl 3-bromobenzoate-co-vinyl acetate-co-vinyl alcohol) (79/12/9 molar ratio) was used in place of poly(vinyl benzoate-co-vinyl acetate). A good quality flexible film free of crazing was obtained. The thickness of the acid photogenerating layer was 7.6 μm.

EXAMPLE 5

A film was prepared exactly as described in Example 2 except that poly(vinyl cinnamate) was used in place of poly(vinyl benzoate-co-vinyl acetate). A good quality flexible film free of crazing was obtained. The thickness of the acid photogenerating layer was 10.0 μm.

EXAMPLE 6

A film was prepared exactly as described in Example 2 except that poly(vinyl cinnamate-co-vinyl 1-naphthoate) (50/50 molar ratio) was used in place of poly(vinyl benzoate-co-vinyl acetate). A good quality flexible film free of crazing was obtained. The thickness of the acid photogenerating layer was 9.2 μm.

EXAMPLE 7

A film was prepared exactly as described in Example 2, except that a conventional polymeric binder material (phenoxy resin, which is a copolymer of bisphenol A and epichlorohydrin), was used in place of poly(vinyl benzoate-co-vinyl acetate). The example is outside the scope of the invention because the polymer binder material is not of the kind used in the present invention and is included as a comparative example. This film exhibited defects such as repellancies i.e., small areas on the film where the barrier layer was exposed, and convective cells caused by non-uniform coverage of the acid photogenerating layer over the barrier layer which gave the layer an appearance somewhat similar to an orange peel. The thickness of the acid photogenerating layer was about 8.8 μm.

EXAMPLE 8

A film was prepared exactly as described in Example 2, except that a conventional polymeric binder material (i.e., poly(vinyl 2-hydroxypropyl methacrylate) was used in place of poly(vinyl benzoate-co-vinyl acetate) and THF was used in place of dichloromethane. This example is outside the scope of the invention because the polymeric material used as the binder is not of the kind employed in the present invention and is used as a comparative example. This film exhibited a brittleness which was not present with the previous films of Example 2 through 7. The thickness of the acid photogenerating layer was 9.6 μm.

TABLE

| | Low RH (70° F./30% RH) | | High RH (80° F./70% RH) | |
|---|---|---|---|---|
| Example | $V_{max}$ | del $V/V_{max}$ | $V_{max}$ | del $V/V_{max}$ |
| 2 | 832 | 0.71 | 720 | 0.95 |
| 3 | 814 | 0.78 | 632 | 0.66 |
| 4 | 836 | 0.81 | 682 | 0.80 |
| 5 | 829 | 0.73 | 682 | 0.84 |
| 6 | 830 | 0.74 | 693 | 0.77 |
| 7 | 821 | 0.64 | 647 | 0.97 |

TABLE-continued

| Example | Low RH (70° F./30% RH) $V_{max}$ | Low RH (70° F./30% RH) del $V/V_{max}$ | High RH (80° F./70% RH) $V_{max}$ | High RH (80° F./70% RH) del $V/V_{max}$ |
|---|---|---|---|---|
| 8 | * | — | * | — |

*Could not be charged.

As shown in the Table, Comparative Example 7 shows a difference of del $V/V_{max}$ of 0.33 between the low and high RH measurements while the films comprising the inventive binders of the present invention (Examples 2–6) exhibit a much smaller variation in del $V/V_{max}$ at the low and high RH conditions. In fact, in the case of Example 4, essentially no variation in del $V/V_{max}$ at the low and high RH condition is observed at all.

The invention has been described in detail with particular reference to preferred embodiments thereof, but it will be understood that variations and modifications can be effected within the spirit and scope of the invention.

We claim:

1. A photoelectrographic element comprising a conductive layer in electrical contact with an acid photogenerating layer which (a) is free of photopolymerizable materials and (b) comprises an electrically insulating binder and an acid photogenerator, said binder comprising a polymer having as a repeating unit thereof a moiety selected from the group consisting of:

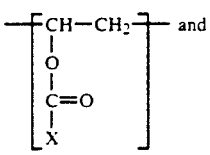

I

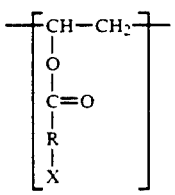

II wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent and aromatic radicals having a halogen substituent.

2. A photoelectrographic element of claim 1 wherein said polymer is a homopolymer.

3. A photoelectrographic element of claim 1 wherein the acid photogenerator is selected from the group consisting of aromatic onium salts and 6-substituted-2,4-bis(trichloromethyl)-5-triazines.

4. A photoelectrographic element of claim 1 wherein the acid photogenerator is selected from the group consisting of arylhalonium salts and triarylsulfonium salts.

5. A photoelectrographic element of claim 1 wherein the acid photogenerator is selected from the group consisting of:

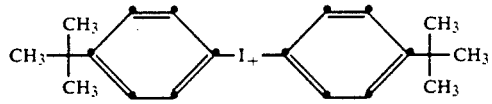

$CF_3SO_3^-$

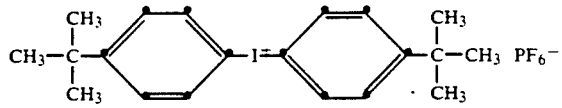

and

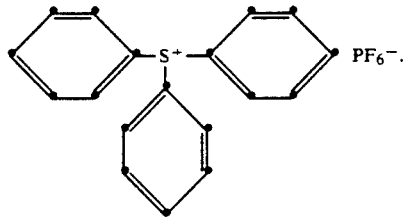

6. A photoelectrographic element of claims 1, 2, 3, 4 or 5 wherein the acid photogenerating layer also comprises a spectral sensitizer.

7. A photoelectrographic element of claims 1, 2, 3, 4 or 5 in which the acid photogenerating layer comprises at least one weight percent of the acid photogenerator.

8. A photoelectrographic element of claim 1 wherein X is an aromatic radical selected from the group consisting of unsubstituted phenyl radicals, phenyl radicals having an acyl substituent containing 1 to about 6 carbon atoms in the acyl moiety, phenyl radicals having an alkyl substituent containing 1 to about 6 carbon atoms in the alkyl moiety, phenyl radicals having an alkoxy substituent containing 1 to about 6 carbon atoms in the alkoxy moiety and phenyl radicals having a halogen substituent.

9. A photoelectrographic element of claim 1 wherein the polymer is poly(vinyl benzoate).

10. A photoelectrographic element of claim 1 wherein the polymer is poly(vinyl 3-bromobenzoate).

11. A photoelectrographic element of claim 1 wherein the polymer is poly(vinyl 2-naphthoate).

12. A photoelectrographic element of claim 1 wherein the polymer is poly(vinyl cinnamate).

13. A photoelectrographic element of claim 1 wherein the polymer is poly(vinyl cinnamate-co-vinyl 1-naphthoate).

14. A photoelectrographic element of claim 1 wherein the conductive layer comprises a polyester having a thin electroconductive layer of cuprous iodide coated thereon.

15. A photoelectrographic element of claim 1 wherein said polymer is a copolymer comprising at least two different repeating units, one of said repeating units selected from the group consisting of:

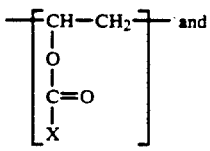

I

-continued

II

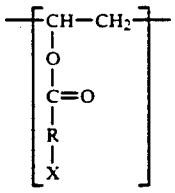

wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent and aromatic radicals having a halogen substituent; and another of said repeating units selected from the group consisting of:

III

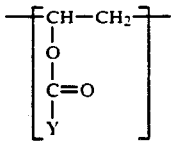

and

IV

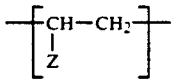

wherein Y represents an alkyl radical having 1 to 8 carbon atoms, and Z represents a hydroxy radical.

16. A photoelectrographic element of claim 15 wherein the acid photogenerator is selected from the group consisting of aromatic onium salts and 6-substituted-2,4-bis(trichloromethyl)-5-triazines.

17. A photoelectrographic element of claim 15 wherein the acid photogenerator is selected from the group consisting of arylhalonium salts and triarylsulfonium salts.

18. A photoelectrographic element of claim 15 wherein the acid photogenerator is selected from the group consisting of:

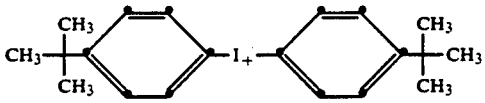

$CF_3SO_3^-$

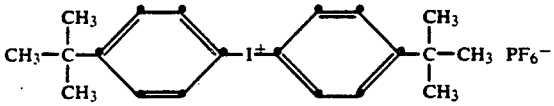

and

-continued

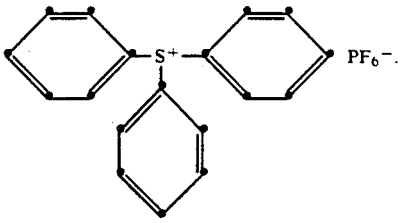

19. A photoelectrographic element of claims 15, 16, 17, or 18 wherein the acid photogenerating layer also comprises a spectral sensitizer.

20. A photoelectrographic element of claims 15, 16, 17 or 18 is which the acid photogenerating layer also comprises at least one weight percent of the acid photogenerator.

21. A photoelectrographic element of claim 15 wherein X is an aromatic radical selected from the group consisting of unsubstituted phenyl radicals, phenyl radicals having an acyl substituent containing 1 to about 6 carbon atoms in the acyl moiety, phenyl radicals having an alkyl substituent containing 1 to about 6 carbon atoms in the alkyl moiety, phenyl radicals having an alkoxy substituent containing 1 to about 6 carbon atoms in the alkoxy moiety and phenyl radicals having a halogen substituent.

22. A photoelectrographic element of claim 15 wherein the copolymer is poly(vinyl benzoate-co-vinyl acetate).

23. A photoelectrographic element of claim 15 wherein the copolymer is poly(vinyl bromobenzoate-co-vinyl acetate).

24. A photoelectrographic element of claim 15 wherein the copolymer is poly(vinyl 3-bromobenzoate-co-vinyl acetate-co-vinyl alcohol).

25. A photoelectrographic element of claim 15 wherein the conductive layer comprises a polyester having a thin electroconductive layer of cuprous iodide coated thereon.

26. A photoelectrographic method of imaging comprising the steps of:

(a) providing a photoelectrographic element comprising a conductive layer in electrical contact with an acid photogenerating layer which (i) is free of photopolymerizable materials and (ii) comprises an electrically insulating binder and an acid photogenerator wherein said electrically insulating binder comprises a polymer having as a repeating unit thereof a moiety selected from the group consisting of:

I

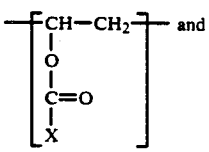

and

-continued

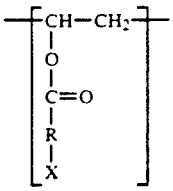

wherein R represents an alkylene group having 2, 4 or 6 carbon atoms and X represents an aromatic radical selected from the group consisting of unsubstituted aromatic radicals, aromatic radicals having an acyl substituent, aromatic radicals having an alkyl substituent, aromatic radicals having an alkoxy substituent, and aromatic radicals having a halogen substituent;

(b) carrying out the following steps (b)(i) and (b)(ii) concurrently or separately in any order, to form an electrostatic latent image, (i) imagewise exposing the acid photogenerating layer to actinic radiation, (ii) electrostatically charging the acid photogenerating layer, and (c) developing the electrostatic latent image with charged toner particles.

27. The method of claim 26 wherein step (i) is carried out prior to step (ii).

28. The method of claim 26 wherein step (ii) is carried out prior to step (i).

29. The method of claim 26 wherein said polymer is a homopolymer.

30. The method of claim 26 wherein the acid photogenerator is selected from the group consisting of onium salts and 6-substituted-2,4-bis(trichloromethyl)-5-triazines.

31. The method of claim 26 wherein the acid photogenerator is selected from the group consisting of arylhalonium salts and triarylsulfonium salts.

32. The method of claim 26 wherein the acid photogenerator is selected from the group consisting of:

II

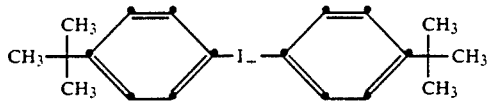

$CF_3SO_3-$

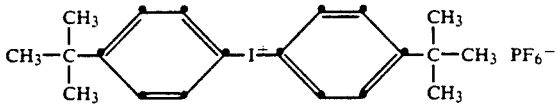

and

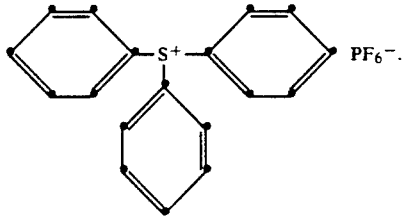

33. The method of claim 26 wherein the acid photogenerating layer also comprises a spectral sensitizer.

34. The method of claim 26 in which the acid photogenerating layer comprises at least one weight percent of the acid photogenerator.

35. The method of claim 26 wherein X is an aromatic radical selected from the group consisting of unsubstituted phenyl radicals, phenyl radicals having an acyl substituent containing 1 to about 6 carbon atoms in the acyl moiety, phenyl radicals having an alkyl substituent containing 1 to about 6 carbon atoms in the alkyl moiety, phenyl radicals having an alkoxy substituent containing 1 to about 6 carbon atoms in the alkoxy moiety and phenyl radicals having a halogen substituent.

36. The method of claim 26 wherein the polymer is poly(vinyl benzoate).

37. The method of claim 26 wherein the polymer is poly(vinyl 3-bromobenzoate).

38. The method of claim 26 wherein the polymer is poly(vinyl 2-naphthoate).

39. The method of claim 26 wherein the polymer is poly(vinyl cinnamate).

40. The method of claim 26 wherein the polymer is poly(vinyl cinnamate-co-vinyl 1-naphthoate).

41. The method of claim 26 wherein the conductive layer comprises a polyester having a thin electroconductive layer of cuprous iodide coated thereon.

* * * * *